United States Patent [19]

Stager

[11] 4,186,445

[45] Feb. 5, 1980

[54] DISPOSABLE COSMETIC GLOVE

[76] Inventor: Phyllis H. Stager, 7619 Chattington, Dallas, Tex. 75240

[21] Appl. No.: 882,432

[22] Filed: Mar. 3, 1978

Related U.S. Application Data

[63] Continuation-in-part of Ser. No. 782,004, Mar. 28, 1977, Pat. No. 4,122,554.

[51] Int. Cl.[2] ..... A41D 19/00

[52] U.S. Cl. ..... 2/164

[58] Field of Search ..... 128/260, 268, 26, 65, 128/157; 2/164, 167

[56] References Cited

U.S. PATENT DOCUMENTS

| | | | |
|---|---|---|---|
| 2,653,601 | 9/1953 | Morrison | 128/26 UX |
| 2,781,764 | 2/1957 | Miller | 128/65 |
| 3,874,000 | 4/1975 | Altman | 2/158 |

*Primary Examiner*—Doris L. Troutman

*Attorney, Agent, or Firm*—Dennis T. Griggs

[57] ABSTRACT

A disposable cosmetic glove is disclosed which includes an outer glove shell of lotion impervious material and an inner glove lining of lotion absorbent material. The inner glove lining is preferably uniformly impregnated with a cosmetic lotion; however, the glove may be provided with a lining which is not impregnated thereby permitting a lotion of personal choice to be injected into the lining prior to use. In a preferred embodiment, the disposable glove comprises an outer shell of thermoplastic resin material to which a thin layer of polyether or polyester urethane foam is bonded.

7 Claims, 2 Drawing Figures

DISPOSABLE COSMETIC GLOVE

CROSS-REFERENCE TO RELATED APPLICATION

This application is a continuation-in-part of application Ser. No. 782,004 U.S. Pat. No. 4,122,554 entitled "Disposable Cosmetic Glove", filed Mar. 28, 1977 by Phyllis Hugo Stager.

BACKGROUND OF THE INVENTION

1. Field of the Invention

The present invention relates generally to the art of cosmetic appliances, and in particular, to a disposable hand care glove.

2. Description of the Prior Art

Lotions, creams, oils and the like are commonly used for softening, healing and generally beautifying the skin of a person's hands. These cosmetic preparations are usually applied simply by rubbing the lotion or cream directly onto the hands. The soothing, therapeutic effect is best obtained by saturating the skin for a considerable length of time to permit the lotion or cream to penetrate and soften the skin to the desired depth. A one-time application of lotion to the skin such as by manually rubbing the lotion into the skin cannot provide the desired depth of penetration and continued exposure to the lotion since the lotion is quickly rubbed off of the skin when brought in contact with articles such as clothing or bed linen.

The prior art discloses a number of articles of apparel and applicator pads which conserve the cosmetic lotion while the skin is being treated. For example, U.S. Pat. No. 2,501,565 discloses a hand mitten impregnated with a cream such as lanolin and lemon oil; U.S. Pat. No. 2,916,036 discloses a rubber glove, the lining of which is impregnated with an unguent material such as lanolin; other patents disclosing gloves impregnated with creams include U.S. Pat. Nos. 3,116,732; 3,342,182; 3,298,368; 3,384,083; and 3,499,446. Other articles of apparel impregnated with various therapeutic cream or oil formulations are disclosed in U.S. Pat. Nos. 3,354,884 (facial mask); 2,664,087 (foot slipper); and 3,489,884 (diaper).

Patents disclosing applicator pads or cloths or paper impregnated with creams or cream-like materials include U.S. Pat. Nos. 1,836,833; 2,495,066; 2,999,265; 3,624,224; and 3,896,807.

The conventional cosmetic appliances are typically formed by a reusable outer glove which may have lotion applied directly to its interior or which may carry a lotion saturated insert which may be removed from the outer glove after use. Prior to using the glove again, its interior must be cleaned or otherwise sanitized. A requirement that the outer glove shell be cleaned or sanitized after use is a serious drawback because of the inconvenience involved.

SUMMARY OF THE INVENTION

The principal object of the invention is the provision of a disposable cosmetic glove which simplifies the application of a cosmetic lotion or cream to a person's hands which is convenient to use, sanitary, and which aids in promoting the absorption of the lotion or cream or cosmetic preparation into the skin for an extended period of time while conserving the lotion or cream during the treatment.

These features are provided by a disposable cosmetic glove which comprises generally an outer glove shell which is characterized by superposed first and second layers of lotion impervious material and an inner glove lining formed by superposed first and second lotion absorbent layers. The inner glove lining is preferably uniformly impregnated with a cosmetic lotion; however, the glove may be provided with a lining which is not impregnated thereby permitting a lotion of personal choice to be injected into the lining prior to use. The shell and lining layers are sealed together along the marginal edge of the glove thereby defining a central hand receiving chamber.

In a preferred embodiment, the shell or outer layer is made of a thermoplastic resin material such as polyethelene and the lining is a layer of expanded polymeric material such as foamed polyurethane bonded or laminated to the shell. Preferably, the lining is an expanded polymeric material selected from the group consisting essentially of foamed polyether urethane and foamed polyester urethane.

Because of the simple construction of the glove, it is convenient to use and is relatively inexpensive so that it can be readily disposed of after each treatment. Because it is completely disposable, the sanitation problems associated with reusable cosmetic gloves are thereby avoided. In addition to conserving the hand treatment lotion or other cosmetic preparation, the disposable glove also provides protection against staining or in any way soiling clothing or other materials such as bed linen which might otherwise be soiled if a lotion or cosmetic preparation were used without a covering.

BRIEF DESCRIPTION OF THE DRAWING

The novel features which characterize the invention are set forth in the appended claims. The invention together with additional objects and advantages thereof will be best understood from the following description of a preferred embodiment when read in connection with the accompanying drawing, in which:

DETAILED DESCRIPTION

Figure 1:
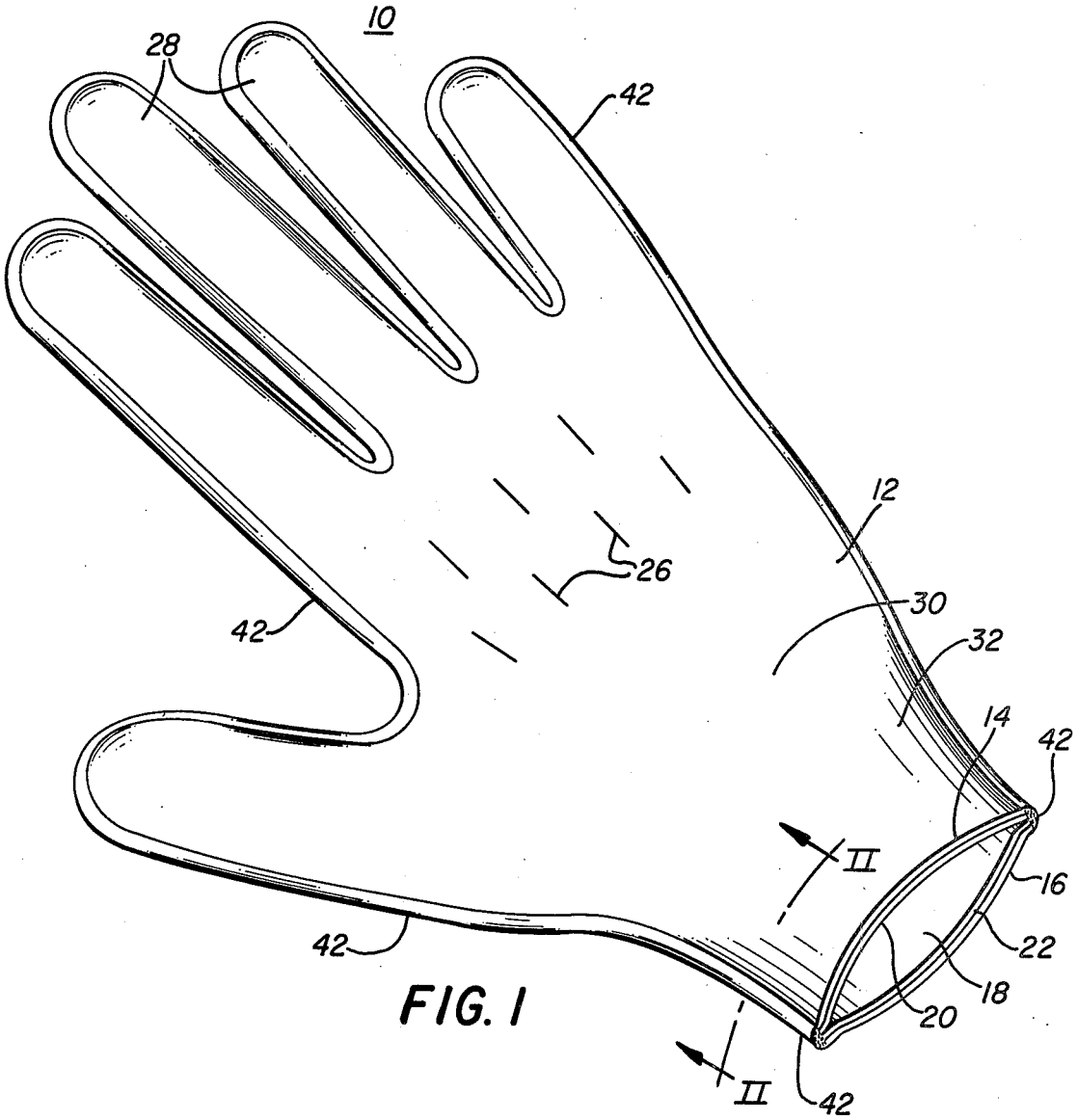
FIG. 1 is an isometric view of a glove constructed according to the teachings of the invention.

Referring now to the drawing, and in particular to FIG. 1 thereof, a preferred embodiment of the present invention comprises generally a disposable cosmetic glove 10 for continuously applying a cosmetic preparation such as a lotion or cream for cosmetic treatment of the hand. The glove 10 can be constructed in different sizes, for example large, medium and small, to accommodate hands of different dimensions.

The glove 10 comprises an outer glove shell 12 which is characterized by superposed first and second layers 14, 16 of a lotion impervious material. An inner glove lining 18 is disposed in nesting relation within the shell 12 intermediate the first and second impervious layers 14, 16. The lining 18 is characterized by superposed first and second lotion absorbent layers 20, 22 which are preferably uniformly impregnated with a cosmetic lotion 24. However, the glove 10 may be provided with the lining layers 20, 22 untreated thereby permitting a person to inject a lotion of personal choice into the lining prior to use. In connection with the use of the glove having an untreated lining, it is anticipated that the user will first thoroughly saturate her (or his) hands with lotion, and will also thoroughly saturate the interior of the lining 18 prior to use.

Various types of materials may be used to form the glove 10. For example, materials such as vinyl, polyethelene or other suitable polymer materials may be used to form the outer glove shell 12. The outer glove shell 12 preferably comprises a lotion impervious, heat sealable material such as a film of thermoplastic resin, and in particular, polyethylene, polypropylene, Mylar, nylon, vinyl resins such as polyvinylidne chloride, polyvinyl chloride, polyvinyl acetate and their mixtures or copolymers and the like film-forming resins are suitable. Because of the lightweight, disposable nature of the glove, the thermoplastic resin film need only be 1–2 mils thick. Still other combinations of suitable materials for constructing the outer shell 12 would be a polyethylene coated paper or fabric substrate.

The inner lining 18 preferably comprises an expanded polymeric material which is both heat sealable and lotion absorbent. In particular, a foamed polyurethane material such as foamed polyether urethane and foamed polyester urethane are preferred because of their lotion absorbing properties and because of their agreeable velvet-like properties. In a preferred arrangement, the shell 12 and lining 18 are embodied in a composit substrate in which a lamina of the lotion absorbent material is bonded to a lamina of the lotion impervious material.

Because the lining 18 serves as a reservoir for a quantity of lotion or cosmetic preparation, it is substantially thicker than the outer shell layer 12. Depending upon the properties of the cosmetic preparation, and depending upon the absorbency of the inner lining, the thickness of the lining 18 may range from a few mils up to one hundred mils. When a cosmetic preparation such as an aqueous solution of lanolin is used, a layer of foamed polyurethane having a thickness of 30–60 mils is preferred.

An example of a suitable cosmetic preparation for impregnating the inner lining 18 is an aqueous emulsion of lanolin. Other cosmetic preparations such as glycerine or an oil phase lotion in combination with one or more emulsifying agents which upon the addition of moisture thereto will form a therapeutic cream may be used to good advantage. In that instance, the moisture required to form the cream will be provided by the wearer in the form of moisture and heat produced by the perspiration of the hands.

Figure 2:
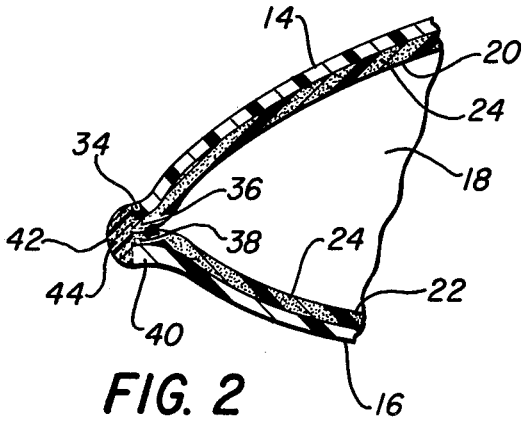
FIG. 2 is a sectional view taken along the lines II—II of FIG. 1.

The cosmetic lotion is indicated generally at 24 in FIG. 2 of the drawing. When a cosmetic preparation such as an aqueous solution of lanolin is used, the outer shell 12 is preferably provided with a plurality of ventilation openings 26 which are preferably elongated slits as shown in FIG. 1 or which may be circular openings. Several rows of openings 26 are provided in the outer shell 12 to assure proper ventilation of the hands. Parallel rows of openings 26 are shown on the back side of the glove 12 which provide adequate ventilation without appreciably weakening the glove structure. Although the openings 26 are shown on the back of the glove, it should be understood that peforations or slits may also be formed on the under side or the reverse side of the glove, provided, however, adequate ventilation is provided without appreciably weakening the glove structure. It should be apparent that the shell 12 may be constructed without the openings 26 thereby providing a water proof glove.

It will be observed that the glove 10 is equipped with individual finger coverings 28 and a hand enclosure portion 30 which is sufficiently large to completely envelop the hand. The glove 10 also includes a wrist portion 32 which converges to define a cuff which is dimensioned to form a snug fit with the wrist to hold the glove onto the hand during the treatment period. It should be obvious that the finger enclosure portions 28 need not be articulated and a single enclosure portion may be provided in the form of a mitten or bootee.

The disposable feature of the glove depends substantially upon the use of relatively inexpensive heat sealable materials for forming the outer shell 12 and the inner lining 18. The thermoplastic resin materials for forming the outer shell 12 and the lotion absorbent expanded polymeric material for forming the lining 18 are well suited for heat sealing fabrication processes. The glove 10 is fabricated generally by arranging the lining layers 20, 22 in superposed relation to each other between the thermoplastic resin layers 14, 16 which comprise the outer shell 12. The superposed layers are cut along a line which defines the periphery of the glove and the edges are then heat-sealed together as shown in FIG. 2. According to that arrangement, an edge portion 34 of the thermoplastic layer 14 is pressed against superposed edge portions 36, 38 of the lining layers 20, 22, respectively, and also against an edge 40 of the thermoplastic resin layer 16. The layers are preferably pressed and heat sealed together to define a fused rim 42 which extends around the periphery of the glove. A suitable heat sealing process is disclosed in U.S. Pat. No. 3,384,083, which is hereby incorporated by reference.

As the rim 42 is compressed, heat is applied causing the edge portions 36, 38 to fuse together with the surrounding edge portions 34, 40. The fused union of the edge portions is indicated generally at 44. This arrangement provides a continuous seal around the periphery of the glove.

The simple construction and assembly of the glove permit it to be produced in quantity by automatic machinery. The glove is preferably fabricated in a relatively sterile environment and is suitably packaged and hermetically sealed at the time of manufacture.

From the foregoing description, it will be seen that a very simple and effective cosmetic appliance has been provided for hand care treatment in a one-time use, throw-away disposable glove. Because it is completely disposable, its use is convenient and sanitary. The velvet-like touch of the expanded polymeric lining makes wearing the glove for extended periods very pleasant and enjoyable. Although it is primarily intended to be worn during inactive periods such as while sleeping, it may also be worn and used to good advantage as an underglove while participating in activities in which the hands are likely to be chapped, for example while participating in cold weather sports such as skiing or ice skating; while driving; for wear under rubber gloves for protecting the hands when washing dishes; for wear in a beauty shop while drying hair; for softening cuticles; and for wear under work gloves while performing household cleaning tasks. The glove also has utility for medical applications in which the liner is impregnated with a medicated preparation for treatment of various dermatology problems or for treatment of burn trauma.

Although a preferred embodiment of the invention has been described in detail, it should be understood that various changes, substitutions, and alterations can be made therein without departing from the spirit and scope of the invention as defined by the appended claims.

What is claimed is:

1. A disposable article to place in contact with the body for use in applying a cosmetic or therapeutic substance to the skin including a substrate and a therapeutic or cosmetic composition carried by substrate, said substrate comprising a first lamina of a lotion impervious thermoplastic resin and a second lamina of a lotion absorbent expanded polymeric material bonded to said first lamina.

2. The article as defined in claim 1 wherein the lotion impervious thermoplastic resin comprises polyethylene.

3. The article as defined in claim 1 wherein the lotion absorbent expanded polymeric material comprises a foamed polymer of urethane.

4. The article as defined in claim 1, said lotion absorbent expanded polymeric material being selected from the group consisting essentially of foamed polyether urethane and foamed polyester urethane.

5. The article as defined in claim 1 wherein said substrate comprises a disposable cosmetic glove having articulated finger coverings.

6. The article as defined in claim 1 wherein said substrate comprises a mitten.

7. The article as defined in claim 1 wherein said substrate comprises a bootee.

* * * * *